US005225018A

United States Patent [19]

Zeldin et al.

[11] Patent Number: 5,225,018

[45] Date of Patent: Jul. 6, 1993

[54] METHOD AND APPARATUS FOR PROVIDING UNIFORMLY DISTRIBUTED FILAMENTS FROM A SPUN FILAMENT BUNDLE AND SPUNBONDED FABRIC OBTAINED THEREFROM

[75] Inventors: Leon M. Zeldin, Greer, S.C.; Ronald E. Lamkin, Washougal, Wash.; Joseph E. Werner, Gray Court, S.C.

[73] Assignee: Fiberweb North America, Inc., Simpsonville, S.C.

[21] Appl. No.: 433,167

[22] Filed: Nov. 8, 1989

[51] Int. Cl.[5] ..... D04N 3/16

[52] U.S. Cl. ..... 156/167; 156/181; 425/131.5; 425/174.8 E; 425/174.8 R

[58] Field of Search ..... 428/296; 19/299; 156/167, 181; 264/175, 290.5, 555; 425/72.2, 381, 131.5, 174.8 E, 174.8 R

[56] References Cited

U.S. PATENT DOCUMENTS

| | | | |
|---|---|---|---|
| 2,052,869 | 9/1936 | Coanda | 299/107 |
| 2,158,415 | 5/1939 | Formhals | 18/54 |
| 2,657,433 | 11/1953 | Merriman | 19/48 |
| 3,012,400 | 12/1961 | Corson, Jr. | 239/434.5 |
| 3,163,753 | 12/1964 | Di Sabato et al. | 250/49.5 |
| 3,325,906 | 6/1967 | Franke | 34/10 |
| 3,338,992 | 8/1967 | Kinney | 264/24 |
| 3,402,227 | 7/1968 | Knee | 264/24 |
| 3,431,602 | 3/1969 | Appel | 19/66 |
| 3,578,739 | 5/1971 | George | 18/8 |
| 3,689,608 | 9/1972 | Hollberg et al. | 264/24 |
| 3,713,590 | 1/1973 | Dorschner et al. | 239/597 |
| 3,734,803 | 5/1973 | Lipscomb et al. | 156/441 |
| 3,736,211 | 5/1973 | Lipscomb et al. | 156/441 |
| 3,738,894 | 6/1973 | Lipscomb et al. | 156/441 |
| 3,766,606 | 10/1973 | Piper et al. | 19/65 |
| 3,802,980 | 4/1974 | Harmon | 156/181 |
| 3,860,369 | 1/1975 | Brethauer et al. | 415/3 |
| 3,907,208 | 9/1975 | Agnew et al. | 239/318 |
| 3,967,118 | 6/1976 | Sternberg | 250/325 |
| 4,009,508 | 3/1977 | Sternberg | 19/155 |
| 4,148,595 | 4/1979 | Bednarz | 425/75 |
| 4,163,305 | 8/1979 | Semjonow et al. | 19/299 |
| 4,172,307 | 10/1979 | Wagner et al. | 19/299 |
| 4,346,504 | 8/1982 | Birk et al. | 28/240 |
| 4,537,733 | 8/1985 | Farago | 264/9 |
| 4,666,395 | 5/1987 | Shah | 425/377 |
| 4,753,698 | 6/1988 | Hartmann et al. | 156/167 |
| 4,818,466 | 4/1989 | Mente et al. | 264/555 |
| 4,833,758 | 5/1989 | Sano et al. | 19/304 |

FOREIGN PATENT DOCUMENTS

| | | |
|---|---|---|
| 010756 | 10/1979 | European Pat. Off. . |
| 150024 | 1/1985 | European Pat. Off. . |
| 2211102 | 9/1973 | Fed. Rep. of Germany . |
| 47-11246 | 7/1972 | Japan . |
| 49-23259 | 6/1974 | Japan . |
| 60-94663 | 5/1985 | Japan . |

*Primary Examiner*—James J. Bell

*Attorney, Agent, or Firm*—Finnegan, Henderson, Farabow, Garrett & Dunner

[57] ABSTRACT

A method and apparatus for providing uniformly distributed filaments from a spun filament bundle and a process for forming spunbonded fabric having superior uniformity and a favorable ratio between machine and cross direction tensile strengths. The apparatus includes a fiber transfer tube and a pair of adjustable deflector plates. The deflector plates form a channel having a tapering width for transporting the filaments in a stream of high velocity air. The apparatus may also include an electrostatic charging means for applying an electrostatic charge to each individual filament after it exits the channel. The method for providing uniformly distributed filaments includes a first stage of separating the filament bundle by the high velocity stream of air and may also include a second stage of electrostatically charging the filaments to achieve a uniform filament separation. The process for forming spunbonded fabric enables a fabric to be produced having a machine direction to cross direction tensile strength ratio less than about 1.5.

15 Claims, 5 Drawing Sheets

METHOD AND APPARATUS FOR PROVIDING UNIFORMLY DISTRIBUTED FILAMENTS FROM A SPUN FILAMENT BUNDLE AND SPUNBONDED FABRIC OBTAINED THEREFROM

BACKGROUND OF THE INVENTION

The present invention relates to a method and apparatus for providing uniformly distributed filaments from a spun filament bundle. The invention also relates to a process for forming spunbonded nonwoven webs having superior web uniformity and a favorable ratio between machine and cross direction tensile strengths, and the fabric formed by such process.

Nonwoven fabrics can be made from spun filaments by passing freshly extruded filaments on a stream of air through a plurality of filament distribution devices to transport the filaments onto a moving conveyor screen or belt where a nonwoven web is formed as the conveyor moves past the filament distribution devices. The nonwoven web can then be bonded, utilizing any one of a variety of known methods, to produce an integrated web or fabric.

To obtain nonwoven webs of high quality, it is important that the filaments being supplied to the moving conveyor be separated from each other so that they can be uniformly distributed onto the moving conveyor. It is known in the prior art that transporting the spun filaments by a stream of turbulent air will tend to separate the filaments from each other to a certain degree. It is also known that separation of spun filaments can be achieved by application of an electrostatic charge, i.e., a corona discharge, to the filaments prior to supplying the filaments onto the moving conveyor.

One of the problems encountered in forming a nonwoven web from spun filaments is achieving adequate filament separation so that the filaments can be uniformly distributed onto the conveyor. If the filaments laid down to form the web stick together, entangle with other filaments or are laid onto the nonwoven fabric too close to other filaments, the web will have a nonuniform, rope-like appearance which is unsightly and undesirable.

Another problem that is encountered in nonwoven web formation is the interaction between adjacent filament distribution devices which are normally provided in series to form a nonwoven web onto the moving conveyor. These adjacent distribution devices may adversely affect the uniform distribution of filaments because the turbulent flow of air from each device tends to interfere with the flow of air from adjacent devices.

Another problem that arises in utilizing an electrostatic charge to enable filament separation in forming a nonwoven web is providing the electrostatic charge uniformly to each individual filament. If the electrostatic charge is applied to a bundle of filaments, those filaments on the surface of the bundle will receive a substantially greater charge than those filaments at the interior of the bundle. This will result in a nonuniform application of charge to the filaments and thus inadequate spreading.

A further problem in forming nonwoven webs by the use of a pneumatic filament distribution device is the tendency of individual filaments to become entangled with one another, thus preventing the effective separation and spreading of the filaments. Because of this tendency for filament entanglement, lower air rates are often required, which means that fewer filaments per device can be supplied to the conveyor and thus a greater number of filament distribution devices are required to form the nonwoven web.

A problem in forming nonwoven webs by the use of standard tubular distribution devices is that the pattern or "footprints" formed by the devices on the moving conveyor tend to become elongated, due to aerodynamic effects created by the proximity of adjacent devices, in the direction of conveyor movement (machine direction) causing filaments to be oriented predominantly in that direction. Nonwoven fabrics made by such processes thus tend to be weak in the direction perpendicular to the conveyor (cross direction) due to lack of orientation in that direction.

It is an object of the present invention to provide a device and method for uniformly distributing filaments from a spun filament bundle onto a moving conveyor.

It is another object of the invention to provide a filament distribution device that allows a higher air flow rate to be utilized without filament entanglement and thus a greater number of filaments per device can be uniformly distributed onto a moving conveyor.

It is also an object of the invention to provide a device and method for pneumatically separating filaments from a spun filament bundle while minimizing the amount of air that interferes with adjacent devices.

It is another object of the invention to provide a device anc method for applying an electrostatic charge to separate filaments from a spun filament bundle.

It is also an object of the invention to provide a device and method for enabling an electrostatic charge to be uniformly applied to substantially all the filaments from a spun filament bundle.

It is a further object of the invention to provide a filament distribution device having adjustable deflector plates which enables different types of spun filament bundles to be uniformly distributed onto a moving conveyor.

It is a further object of the invention to provide a filament distribution device capable of adjustable orientation with respect to the receiving conveyor to enable filament layers to be distributed at varying angles onto the conveyor.

It is a further object of the invention to provide a process for producing spunbonded nonwoven fabrics that have a machine direction to cross direction tensile strength ratio less than about 1.5.

It is a further object of the invention to provide a spunbonded nonwoven fabric that has a uniform appearance and a machine direction to cross direction tensile strength ratio less than about 1.5.

Additional objects and advantages of the invention will be set forth in the description which follows and in part will be obvious from the description, or may be learned by practice of the invention. The objects and advantages of the invention may be realized and obtained by means of the instrumentalities and combinations particularly pointed out in the appended claims.

SUMMARY OF THE INVENTION

The present invention provides an apparatus for providing uniformly distributed filaments from a spun filament bundle. This apparatus includes fiber transfer means for receiving and pneumatically transporting spun filament bundles. First and second deflector plates are attached to the fiber transfer means and disposed in substantial face-to-face relation to each other. The fiber transfer means includes an entrance and an exit. The deflector plates extend beyond the exit of the fiber transfer means to form a filament transfer channel between the first and second deflector plates. The filament transfer channel has an exit adjacent to an end of the second deflector plate. The first deflector plate has a length extending beyond the exit of the filament transfer channel. The filament transfer channel has a width that tapers in the direction of filament flow from the fiber transfer means exit to the exit of the filament transfer channel. The apparatus may also further include electrostatic charging means disposed beyond the filament transfer channel exit. The electrostatic charging means include at least one charging pin for uniformly applying an electrostatic charge to the filaments as they exit the filament transfer channel.

The present invention also provides a method for providing uniformly distributed filaments from spun filament bundles. The method includes transporting spun filament bundles pneumatically through fiber transfer means to a filament transfer channel and spreading and separating the spun filament bundles by directing them in a current of air through the filament transfer channel to form a thin layer of separated, spread filaments. The filament transfer channel is defined by two deflector plates in substantial face-to-face relation with each other. The deflector plates are oriented so that the filament transfer channel has a tapered width, with its greatest width at the exit of the fiber transfer means and its narrowest width at the exit of the filament transfer channel. The method may also further include applying a uniform charge to the separated spread filaments after they exit the filament transfer channel so that each filament is provided with substantially the same amount of charge.

The present invention further provides a method for producing a nonwoven spunbonded fabric having a machine direction to cross direction tensile strength ratio less than about 1.5. The process includes providing a plurality of the above described filament distribution devices above a moving conveyor. The process also includes extruding a thermoplastic polymeric material through a plurality of spinnerettes to form a plurality of spun filament bundles.

The process also includes transporting the plurality of spun filament bundles through a plurality of the filament distribution devices of this invention to form a plurality of thin layers of separated filaments. The process further includes depositing the separated filaments onto the moving conveyor at selected angles to form a web followed by bonding the web to form a nonwoven spunbonded fabric. The plurality of thin layers of separated filaments are deposited onto the moving conveyors at angles sufficient to enable the formation of a nonwoven spunbonded fabric having a machine direction/cross direction tensile strength ratio less than about 1.5.

The present invention further provides a nonwoven spunbonded fabric having a uniform appearance and having a machine direction/cross direction tensile strength ratio less than about 1.5.

The accompanying drawings, which are incorporated in and constitute a part of the specification, together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

In accordance with the present invention, there is provided an apparatus for providing uniformly distributed filaments from a spun filament bundle including fiber transfer means for receiving and pneumatically transporting spun filament bundles and first and second deflector plates attached to the fiber transfer means and disposed in substantially face-to-face relation to each other. As embodied in FIG. 1, the apparatus 10 for providing uniformly distributed filaments from a spun filament bundle includes fiber transfer means shown in FIG. 1 as fiber transfer tube 12. Spun filament bundles freshly produced from extrusion devices (not shown) are provided to a fiber transfer tube entrance 14 and are transported by a high velocity stream of air through fiber transfer tube 12 to fiber transfer tube exit 16.

Figure 1:
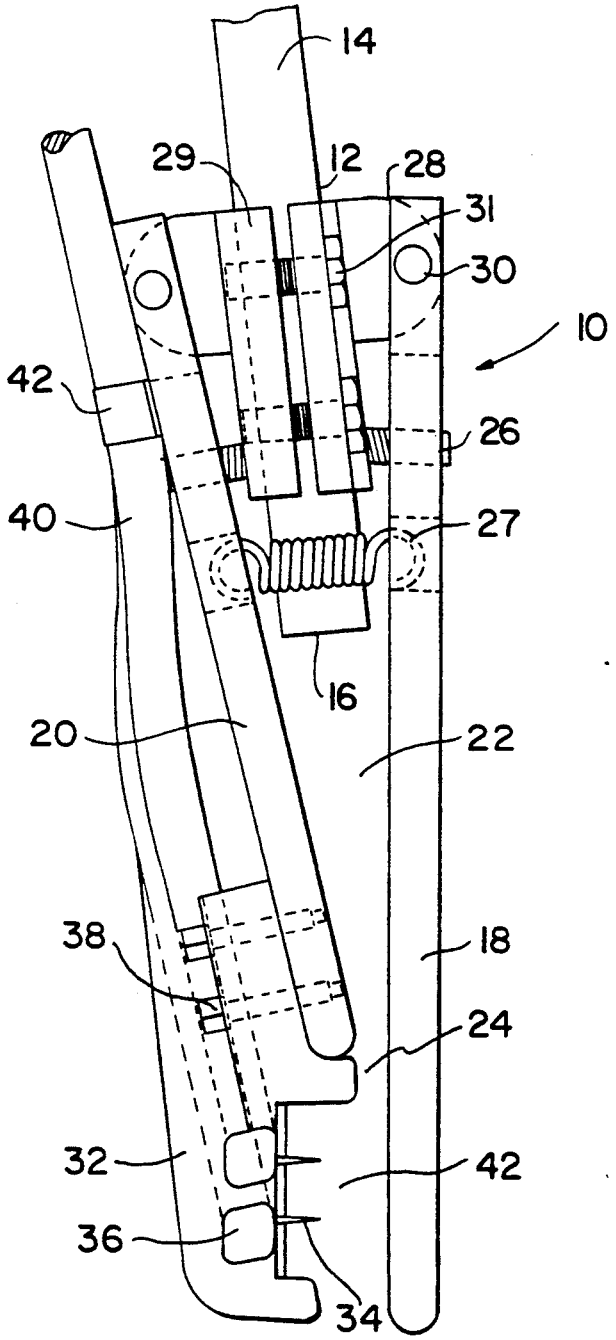
FIG. 1 is a diagram illustrating one side view of the apparatus of the invention.
Figure 3:
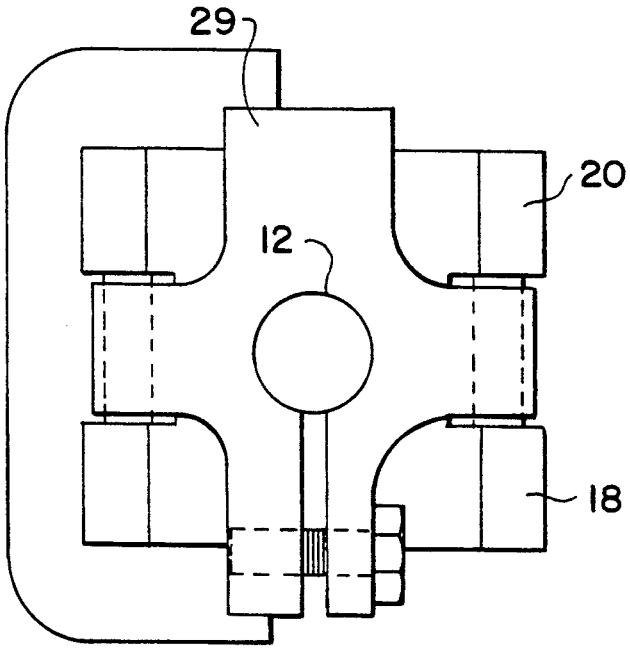
FIG. 3 is a diagram illustrating an end view of the apparatus of the present invention.

First and second deflector plates 18 and 20, as shown by FIGS. 1 and 3, may be attached to fiber transfer tube 12 by a holding bracket 29 attached to fiber transfer tube 12 by screws 31. Holding bracket 29 includes clevises 28 which engage with pins 30 in first and second deflector plates 18 and 20 to allow adjustable engagement of first and second deflector plates 18 and 20 to fiber transfer tube 12. In addition, first and second deflector plates 18 and 20, as shown in FIG. 1, may include set screws 26 which can be adjusted into contact with bracket 29 on fiber transfer tube 12. Set screws 26 can be utilized to adjust the angle of orientation of first and second deflector plates 18 and 20 relative to fiber transfer tube 12. First and second deflector plates 18 and 20 may also be further secured in place by extension springs 27, which enable easy access to the internal surfaces of first and second deflector plates 18 and 20 for cleaning.

In accordance with the invention, the first and second deflector plates are disposed in substantial face-to-face relation to each other and extend beyond the exit of the fiber transfer means to form a filament transfer channel. The filament transfer channel has an exit adjacent to an end of the second deflector plate, with the first deflector plate having a length extending beyond the exit of the filament transfer channel. As embodied by FIG. 1, first deflector plate 18 and second deflector plate 20 extend beyond fiber transfer tube exit 16 to form filament transfer channel 22. Filament transfer channel 22 has a filament transfer channel exit 24 which is adjacent the end of second deflector plate 20. First deflector plate 18 extends beyond filament transfer channel exit 24.

In accordance with the invention, the filament transfer channel has a width that tapers in the direction of filament flow from the fiber transfer means exit to the exit of the filament transfer channel. As embodied by FIG. 1, filament transfer channel 22 taper in the direction of filament flow from fiber transfer tube exit 16 to filament transfer channel exit 24. The tapered width of filament transfer channel 22 in the direction of filament flow acts to direct the high velocity flow of air toward filament transfer channel exit 24 to minimize turbulence which can cause entanglement of individual filaments.

First and second deflector plates 18 and 20 are preferably rectilinear in shape. First deflector plate 18 preferably has a length ranging from 6 inches to 12 inches, a width ranging from 3 inches to 4½ inches and a thickness ranging from ⅛ inch to ⅝ inch. Second deflector plate 20 preferably has a length ranging from 4 inches to 8 inches, a width ranging from 3 inches to 4.5 inches and a thickness ranging from ⅛ inch to ⅝ inch. First and second deflector plates 18 and 20 should be made out of a conductive material. One example of such a conductive material is stainless steel. The internal surfaces of first and second deflector plates 18 and 20 may also be coated with a wear resistant material. Fiber transfer tube 12 preferably has an inside diameter ranging from ⅝ inch to ⅞ inch and is preferably composed of stainless steel.

The present inventors have found that the degree of filament entanglement in the apparatus of the invention can be minimized, and thus a maximum flow of air can be utilized without filament entanglement, by adjusting the angle of orientation between first and second deflector plates 18 and 20 to achieve optimum performance. It has been found that first deflector plate 18 should be oriented at an angle ranging from −5° to +14° with respect to a vertical plane. A positive angle as used herein represents an angle with the vertical plane in the direction towards the opposing deflector plate while a negative angle denotes an angle between the plate and the vertical plane in the direction away from the opposing deflector plate. It has been found that second deflector plate 20 should preferably range from 0° to +18° with respect to the vertical plane. A preferred embodiment which has been found to achieve advantageous results is first deflector plate 18 oriented +7° to the vertical plane and second deflector plate 20 oriented +7° to the vertical plane (shown by FIG. 1. A particularly preferred embodiment achieving optimal results is first deflector plate 18 oriented parallel to the vertical plane and second deflector plate 20 oriented +14° to the vertical plane. By adjusting the orientation of first and second deflector plates 18 and 20, it may be possible with the apparatus of the invention to transport up to 300 filaments per tube to a moving conveyor without substantial filament entanglement. This represents a substantial increase over the prior art methods and results in the use of fewer devices and thus increased process efficiency.

Figure 2:
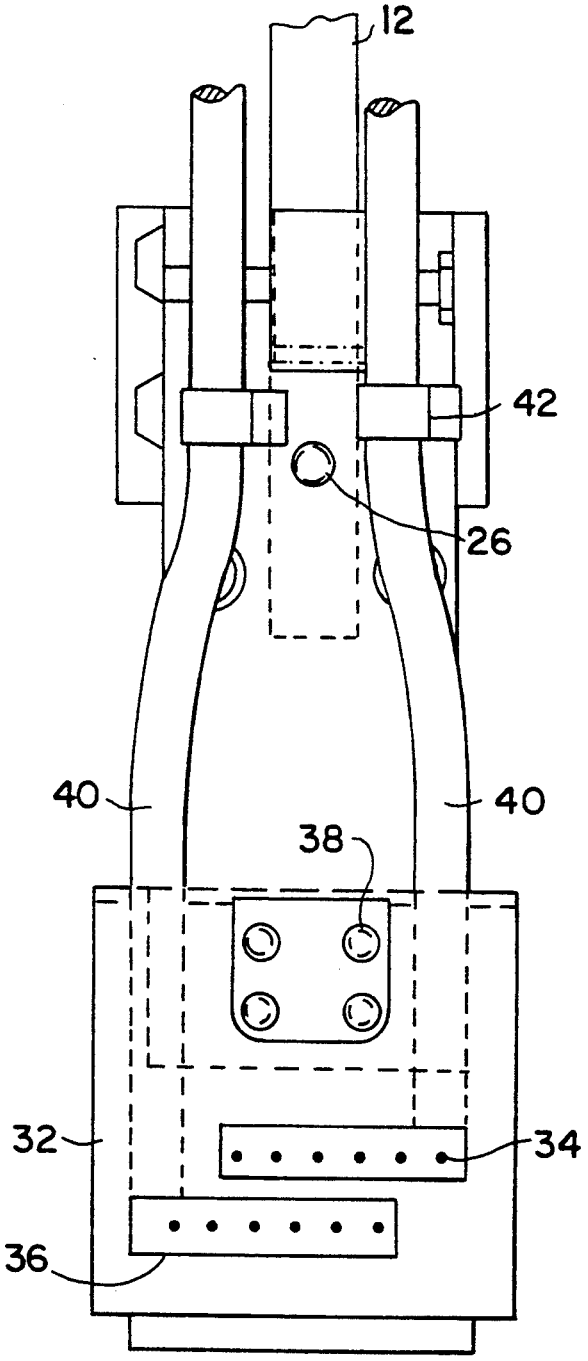
FIG. 2 is a diagram illustrating a side view of the apparatus of the present invention rotated 90° relative to the apparatus illustrated by FIG. 1.

In accordance with a preferred embodiment of the invention, the apparatus for providing uniformly distributed filaments from a spun filament bundle also may include electrostatic charging means disposed beyond the filament transfer channel exit. The electrostatic charging means includes at least one charging pin for uniformly applying an electrostatic charge to the filaments as they exit the filament transfer channel. The electrostatic charging means may function as an additional separation stage. The electrostatic charging means, embodied herein as shown by FIGS. 1 and 2, may consist of a corona discharge assembly device 32 which preferably comprises a housing made of plexiglass. Corona discharge assembly device 32 can be attached to second deflector plate 20 by screws 38. Corona discharge assembly device 32 preferably includes at least one metal bar 36 each embedded therein. It is preferred to utilize two metal bars 36. Metal bars 36 each include a plurality of charging pins 34. Charging pins 34 are preferably evenly spaced from one another in rows perpendicular to the direction of the filament flow and are preferably composed of sharpened monel. Metal bars 34 can be attached to high voltage cables 40 for providing electrostatic charge to charging pins 34. It may be advantageous to provide a different voltage to each row of charging pins 34. The area bounded by first and second deflector plates 18 and 20 beyond filament transfer channel exit 24 is shown in FIG. 1 as electrostatic charging area 42.

In accordance with the invention, a method is provided for uniformly distributing filaments from spun filament bundles including transporting spun filament bundles pneumatically through fiber transfer means to a filament transfer channel and spreading and separating the spun filament bundles by directing them in a current of air through the tapered filament transfer channel to form a thin layer of separated, spread filaments. The rate of air flow through fiber transfer tube 12 preferably ranges between 15–45 standard cubic feet per minute. The high velocity stream of air flowing through fiber transfer tube 12 acts as an initial separation stage to separate the individual filaments from the spun filament bundle. Individual filaments which have been separated to a certain degree by the flow of high velocity air through filament transfer channel 22 exit filament transfer channel 22 at filament transfer channel exit 24. Filament transfer channel exit 24 should be wide enough to allow individual filaments to exit filament transfer channel 22 without plugging filament transfer channel exit 24, and should be narrow enough so that bundles of filaments cannot exit, i.e., only substantially individual layers of filaments should be allowed to pass from filament transfer channel 22. It has been found by the inventors that the optimum width of filament transfer channel 24 is preferably 1/16"-3/16", with the most preferred width being approximately ⅛ inch.

In accordance with a preferred embodiment of the invention, a method is provided which may also include applying a uniform charge to the separated, spread filaments after they exit the filament transfer channel so that each filament is provided with substantially the same amount of charge. The optimum width of filament transfer channel 24 is selected so that a thin layer, preferably a single layer, of individual filaments will enter electrostatic charging area 42 whereby a uniform electrostatic charge can be applied to each filament. If several layers of filaments are allowed to exit at filament transfer channel exit 24, the application of electrostatic charge from charging pins 34 may only be effective in charging those filaments on the outside of the bundle. Thus, the present invention enables a uniform charge to be applied to the individual filaments in electrostatic charging area 42.

As the filaments pass by charging pins 34 in electrostatic charge area 42, a high voltage electrostatic charge between charging pins 34 and conductive first deflector plate 18 is provided to the air and to the filaments in electrostatic charging area 42. This electrostatic charge causes adjacent filaments to repel each other which insures that the filaments exiting the electrostatic charge area 42 are separated and thus have a uniform spread. In order to provide adequate charge to the filaments, it is preferred that electric cables 40 provide an electrostatic charge ranging from 15,000–40,000 V. A DC current supply is normally used to supply the electrostatic charge and charging pins 34 should have either a positive or negative charge depending upon the type of filaments. Fibers such as nylon and rayon should have a positive charge. It is believed that fibers such as polyesters and acrylics may have either a positive or negative charge. Polypropylene fibers should have a negative charge.

As disclosed in FIG. 5, each apparatus 10 for providing uniformly distributed filaments from a spun filament bundle can be utilized in combination with a plurality of similar apparatuses 10, located in rows, to provide the filaments onto a conveyor 44 moving below the plurality of apparatuses 10 to form a nonwoven web. The apparatuses 10 are vertically oriented and can be located above the conveyor 44 in a plurality of rows. First and second deflector plates 18 and 20 prevent the flow of high velocity air from each apparatus 10 from interfering with the flow of high velocity air from adjacent apparatuses.

Figure 4:
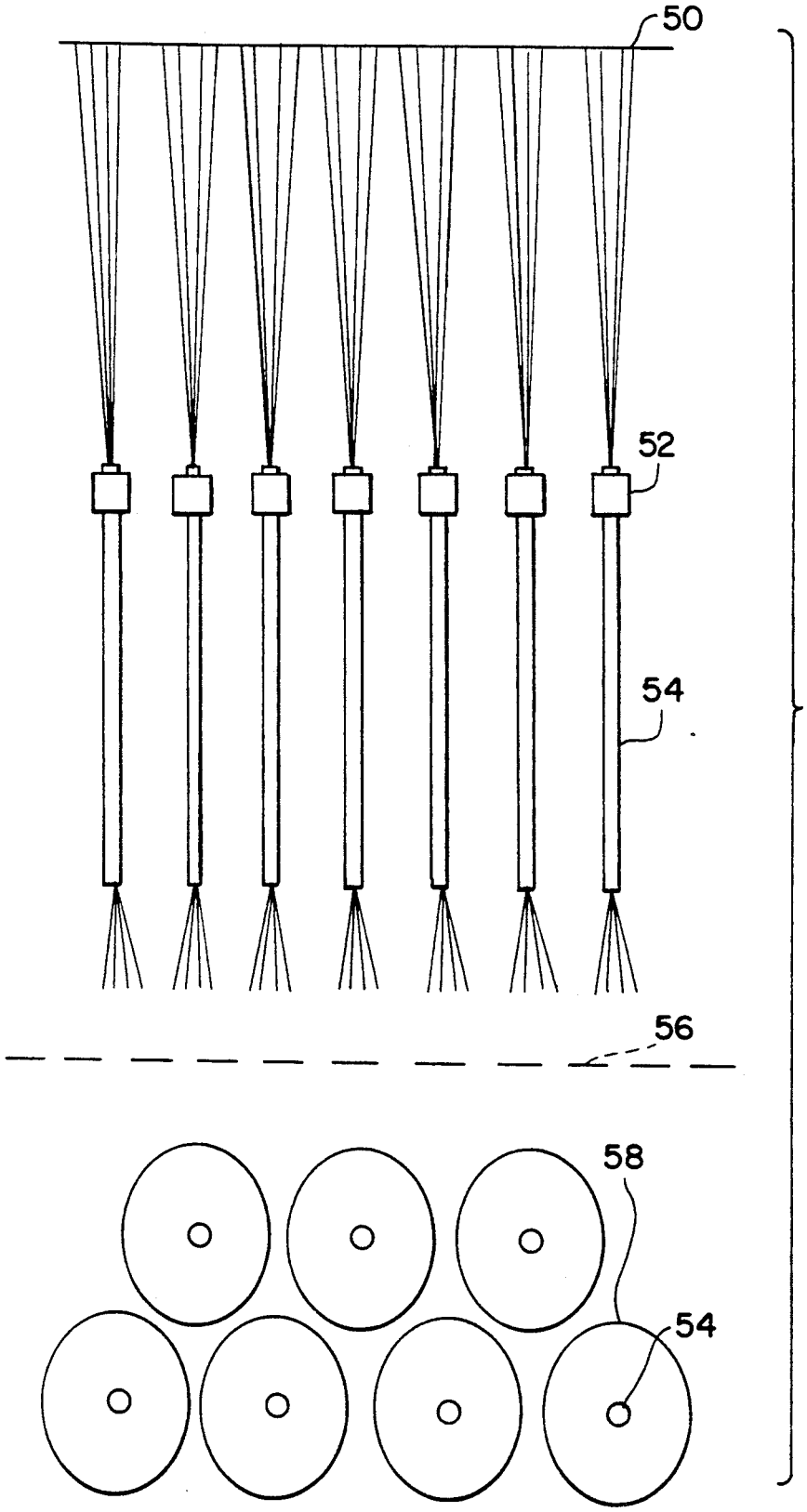
FIG.4 PRIOR ART
FIG. 4 is a diagram illustrating a prior art process for producing a nonwoven spunbonded web.

As disclosed in FIG. 4, prior art processes for producing nonwoven spunbonded fabric utilized a plurality of spinnerettes 50 to draw down continuous filaments to attenuators 52 and extension tubes 54 which provide the filaments by high velocity air onto a moving conveyor 56. The attenuators 52 and extension tubes 54 are arranged side by side along the cross direction of the conveyor 56 and the flow of air from the attenuators 52 and extension tubes 54 forms a pattern or footprint 58 on conveyor 56. Footprints 58 overlap one another on conveyor 56 to enable the deposition of filaments onto conveyor 56 to form a nonwoven web. Footprints 58 issued by prior art attenuators 52 and extension tubes 54 are elongated in the machine direction due to aerodynamic effects from adjacent devices which causes filaments to be oriented on conveyor 56 primarily in the machine direction (MD). Fabrics made from such processes tend to be weak in the cross direction (CD) due to the lack of filament orientation in that direction and thus the tensile strength ratio of the machine direction to the cross direction becomes very large.

In accordance with the invention, a method is provided for producing a nonwoven spunbonded fabric having a machine direction to cross direction tensile strength ratio less than about 1.5. The method includes providing a plurality of the apparatuses of the invention above a moving conveyor, extruding a thermoplastic polymeric material through a plurality of spinnerettes to form a plurality of spun filament bundles, transporting the plurality of spun filament bundles through a plurality of the apparatuses of the invention to form a plurality of thin layers of separated filaments, depositing the separated filaments onto the moving conveyor at selected angles, and bonding the filament web to form a nonwoven spunbonded fabric. The plurality of thin layers of separated filaments are deposited onto the moving conveyor at angles sufficient to enable the formation of a nonwoven spunbonded fabric having a MD/CD tensile strength ratio less than about 1.5.

Figure 5:
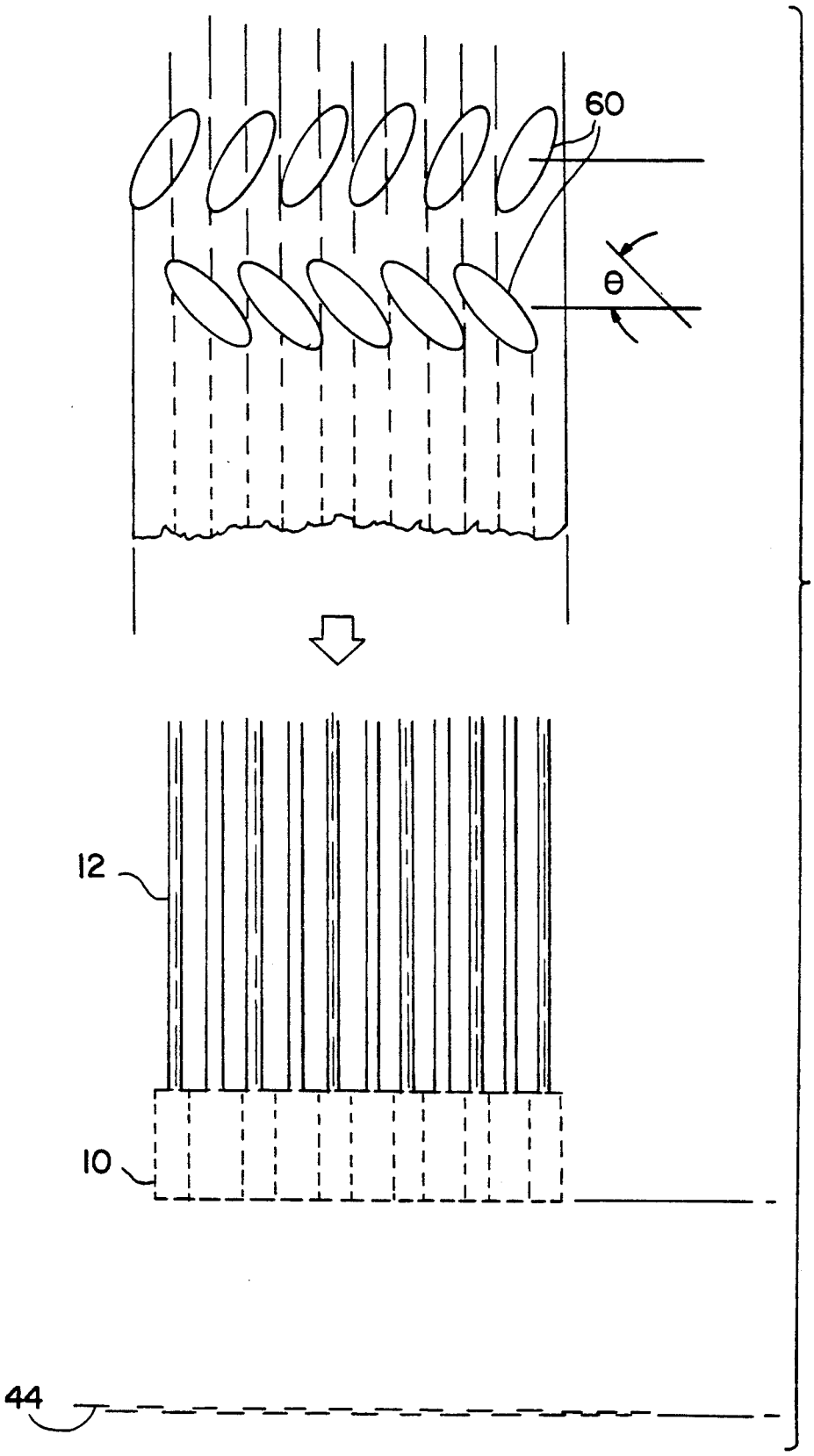
FIG. 5 is a diagram illustrating one embodiment of the process of the present invention for producing a nonwoven spunbonded web.

As embodied by FIG. 5, a plurality of the apparatuses 10 of the invention are provided above a moving conveyor 44 which may be a belt or a wire. Each apparatus 10 is attached to fiber transfer means 12 as described earlier herein. Fiber transfer means 12 preferably is a fiber transfer tube. The plurality of fiber transfer tubes are attached to spinnerettes (not shown) which receive extruded thermoplastic polymeric material from extruders (not shown). The spinnerettes convert the extruded polymer into spun filament bundles. These spun filament bundles are then transported by high velocity air through the apparatuses 10 of the invention as described earlier herein. Apparatuses 10 separate the spun filament bundles into individual filaments and they exit apparatuses 10 as thin layers of separated filaments. These thin layers of separated filaments are deposited onto moving conveyor 44 in patterns or footprints 60. Footprints 60 are in the shape of elongated ellipses with the long diameter of the ellipse corresponding to the length of filament transfer channels of apparatuses 10. Utilizing a plurality of apparatuses 10 arranged side by side in a plurality of rows enables a wide nonwoven spunbonded web to be formed by overlapping footprints 60 on moving conveyor 44.

Footprints 60 can be formed on moving conveyor 44 at various angles between the long axis of the ellipse and the cross direction. This angle is shown by $\theta$ in FIG. 5. By rotating apparatus 10 about fiber transfer means 12 as described earlier herein, it is possible to orient the elliptical footprint 60 onto moving conveyor 44 at any angle. By altering the angle of deposition of footprints 60 onto moving conveyor 44, a nonwoven spunbonded web can be formed that, after bonding, can produce a spunbonded fabric having a machine direction to cross direction tensile strength ratio of less than about 1.5. A fabric having such a ratio is desirable in that it has a substantially uniform strength throughout, while maintaining sufficient strength in the machine direction to retain machinability.

Two rows of footprints 60 formed by 2 rows of apparatuses 10 are illustrated in FIG. 5. However, it may be preferable to utilize more than 2 rows of apparatuses 10. Apparatuses 10 may be oriented so that each row of footprints 60 is oriented in the same direction or they may be oriented so that adjacent rows are oriented perpendicular to each other. In FIG. 5, angle $\theta$ is 45° and the rows are oriented perpendicular to one another. It is to be understood that footprints 60 can be oriented at various angles $\theta$ ranging from 0° to approximately 75°. At angles $\theta$ greater than 75°, the machine direction to cross direction tensile strength ratio becomes too high. Moving conveyor 44 may make a single pass under apparatuses 10 and collect a single layer of filaments or may make a number of passes to collect multiple layers in forming the web. Following deposition of the nonwoven spunbonded web onto moving conveyor 44, the web can be bonded by means known in the art to form a nonwoven spunbonded fabric.

In accordance with the invention, a nonwoven spunbonded fabric is provided having a uniform appearance and having a machine direction to cross direction tensile strength ratio less than about 1.5. This fabric can be utilized as a liner for diapers or sanitary napkins.

The following working Example is provided to illustrate the present invention and some of its advantages. The Example is representative only and is in no way limitative of the invention.

EXAMPLE

A nonwoven spunbonded fabric of filament grade polypropylene resin was produced by a process utilizing 6 spinnerettes, with 7 filament distribution apparatuses of the invention per spinnerette. Filaments from the filament distribution apparatuses were deposited onto a foraminous conveyor to form a web that was 92.7 inches wide. The web was formed by one pass of the conveyor under the filament distribution apparatuses. The filament distribution apparatuses were located in two rows. The rows were 13" apart and each apparatus was 4¼" from adjacent apparatuses.

Each apparatus included two deflector plates of stainless steel having a thickness of ⅝" and a width of 3½". The short deflector plate was 6" long and was oriented at +14° while the long deflector plate was 8" long and was oriented at 0°. The fiber transfer tube had an inside diameter of ½" and was stainless steel. The width of the filament distribution channel exit was ⅛". The voltage applied to the filaments by the electrostatic charging means was 30,000 volts.

The nonwoven spunbonded web was subsequently bonded by a calender between two heated rolls, one having a smooth surface and the other having point engraving with 18% bond area to form a fabric having a basis weight of 0.70 oz./sq.yd. The fabric had a tensile strength in the machine direction of 4.5 lbs./in. and a tensile strength in the cross direction of 4.2 lbs./in. The ratio of machine direction to cross direction tensile strength was 1.07.

Although the present invention has been described in connection with the preferred embodiments, it is understood that modifications and variations may be resorted to without departing from the spirit and scope of the invention. Such modifications are considered to be within the purview and scope of the invention and the appended claims.

What is claimed is:

1. An apparatus for providing uniformly distributed filaments from a spun filament bundle, comprising:

fiber transfer means for receiving and pneumatically transporting spun filament bundles, said fiber transfer means including an entrance and an exit;

first and second deflector plates attached to said fiber transfer means and disposed in substantial face-to-face relation to each other, said deflector plates extending beyond the exit of said fiber transfer means to form a filament transfer channel between said first and second deflector plates, said filament transfer channel having an exit adjacent to an end of said second deflector plate and the first deflector plate having a length extending beyond said exit of said filament transfer channel, said filament transfer channel having a width that tapers in the direction of filament flow from the fiber transfer means exit to the exit of the filament transfer channel; and electrostatic charging means disposed beyond the filament transfer channel exit, and electrostatic charging means including at least one charging pin for uniformly applying an electrostatic charge to the filaments as they exit the filament transfer channel.

2. The apparatus of claim 1, wherein said fiber transfer means is a fiber transfer tube.

3. The apparatus of claim 1, wherein the deflector plates are rectilinear.

4. The apparatus of claim 1, wherein a plurality of charging pins are arranged in rows perpendicular to the direction of filament transport.

5. The apparatus of claim 1, wherein said charging pins have a positive charge.

6. The apparatus of claim 1, wherein said charging pins have a negative charge.

7. The apparatus of claim 2, wherein said deflector plates are pivotally attached to said fiber transfer tube to enable adjustable orientation of said deflector plates relative to one another.

8. The apparatus of claim 2, wherein said deflector plates are rotatably attached to said fiber transfer tube to enable said deflector plates to be adjustably rotated about said fiber transfer tube.

9. The apparatus of claim 1, wherein said electrostatic charging means further includes a plastic body attached to said second deflector plate, said plastic body having a plurality of metal bars imbedded therein containing said plurality of charging pins, said metal bars each being attached to a high voltage cable for providing electrostatic charge.

10. A method for providing uniformly distributed filaments from spun filament bundles comprising:

transporting spun filament bundles pneumatically through fiber transfer means to a filament transfer channel, said filament transfer channel being defined by two deflector plates in substantial face-to-face relation with each other, said deflector plates being oriented so that said filament transfer channel has a tapering width, with its greatest width at the exit of said fiber transfer means and its narrowest width at the exit of said filament transfer channel;

spreading and separating said spun filament bundles by directing them in a current of air through said tapered filament transfer channel to form a thin layer of separated, spread filaments; and applying a uniform charge to said separated, spread filaments after they exit said filament transfer channel so that each filament is provided with substantially the same amount of charge.

11. The method of claim 10, wherein the charge applied to said separated spread filaments is positive.

12. The method of claim 11, wherein the charge applied to said separated spread filaments is negative.

13. The method of claim 10, wherein said fiber transfer means is a fiber transfer tube.

14. The method of claim 10, wherein said filament transfer channels are capable of being adjustably rotated about said fiber transfer means.

15. A process for producing a nonwoven spunbonded fabric comprising:

providing a plurality of the apparatuses of claim 9 above a moving conveyor;

extruding a thermoplastic polymeric material through a plurality of spinnerettes to form a plurality of spun filament bundles;

transporting the plurality of spun filament bundles through a plurality of the apparatuses of claim 9 to form a plurality of thin layers of separated filaments;

depositing the separated filaments onto the moving conveyor at selected angles to form a web; and bonding the filament web to form a nonwoven spunbonded fabric; said plurality of thin layers of separated filaments being deposited onto the moving conveyor at angles sufficient to enable the formation of a nonwoven spunbonded fabric having a desirable MD/CD tensile strength ratio.

* * * * *